US005281022A

United States Patent [19]

Röck

[11] Patent Number: 5,281,022

[45] Date of Patent: Jan. 25, 1994

[54] FRONT PANEL MOUNTING FOR DRAWERS

[75] Inventor: Erich Röck, Höchst, Austria

[73] Assignee: Julius Blum Gesellschaft m.b.H., Höchst, Austria

[21] Appl. No.: 65,649

[22] Filed: Dec. 28, 1992

Related U.S. Application Data

[63] Continuation of Ser. No. 858,952, Mar. 27, 1992, abandoned.

[30] Foreign Application Priority Data

Apr. 2, 1991 [AT] Austria ..... A 697/91

[51] Int. Cl.[5] ..... A47B 88/00

[52] U.S. Cl. ..... 312/348.4; 312/330.1

[58] Field of Search ..... 312/263, 330.1, 348.4

[56] References Cited

U.S. PATENT DOCUMENTS 4,846,538 7/1989 Rock et al. ..... 312/330.1

4,850,659 7/1989 Rock et al. ..... 312/330.1

FOREIGN PATENT DOCUMENTS 390872 7/1990 Austria .

*Primary Examiner*—Peter R. Brown

*Attorney, Agent, or Firm*—Wenderoth, Lind & Ponack

[57] ABSTRACT

A front panel mounting device for a drawer includes a holding part fastened to a drawer front panel and a carrying apparatus fastened to a drawer frame at each of opposite sides of a drawer. The carrying apparatus includes members for adjustment of the front panel as well as a securing part in the form of a housing fixed on the drawer frame and a hook member which is adjustably supported in the housing and which extends at a ring angle to the front panel. The holding part may be suspended on the hook member. The hook member is supported in the housing by means of eccentrics that form the adjustment members. One eccentric is supported by front and rear journals thereof in holes in spaces walls of the drawer frame. The housing is inserted between such walls. Such one eccentric therefore fixes the housing in the drawer frame.

9 Claims, 3 Drawing Sheets

FRONT PANEL MOUNTING FOR DRAWERS

This application is a continuation of now abandoned application, Ser. No. 07/858,952, filed Mar. 27, 1992, now abandoned.

FIELD AND BACKGROUND OF THE INVENTION

The invention relates to a front panel mounting device for a drawer and including a holding part fastened to a drawer front panel and a carrying apparatus inserted into a double-walled drawer frame on either side of the drawer. The carrying apparatus includes means for adjustment of the front panel, as well as a housing fixed in the drawer frame and a hook member which is adjustably supported in the housing. The hook member extends at a right angle to the front panel and the holding part may be suspended thereby. The hook member is supported in the housing by at least one eccentric.

A front panel mounting device of this general type is known from AT-PS 391 406. The purpose of such a front panel mounting device is to hold the front panel adjustably on the drawer so that, when an item of furniture is assembled, the position of the front panel may be adjusted in such a way that identical joints are produced between front panels of all the drawers. The front panel mounting device should also allow the front panel to be assembled quickly and securely on the drawer.

SUMMARY OF THE INVENTION

The object of the invention is to improve the assembly of a front panel mounting device of the type described above.

This object is achieved according to the invention in that an eccentric is supported in two walls of the housing of the carrying apparatus and has front and rear journals extending into holes in the walls of the double-walled drawer frame. The carrying apparatus is inserted between the walls of the door frame, and hence eccentric fixes the carrying apparatus in the drawer frame.

During assembly, the carrying apparatus is simply pushed from the front into the drawer frame, and then the eccentric is inserted laterally through the holes in the walls of the frame into the housing of the carrying apparatus, so that the eccentric penetrates the housing and is supported or held at opposite ends in the frame walls. The eccentric on one side of the drawer frame has a journal of a greater diameter than that on the other side. The smaller-diameter journal is provided with a thickened end which is pressed through the frame wall. The eccentric advantageously is made of plastic material and may be pressed through the frame wall in such a way as to be held therein in the manner of a press stud or a snap fit member.

Advantageously, an eccentric for vertical adjustment of the hook member and an eccentric for clamping the hook member at right angles to the front panel are disposed in each carrying apparatus, and the eccentric for vertical adjustment extends into the holes in the walls of the drawer frame. The hook member is supported, prior to insertion of the eccentric for vertical adjustment, by the eccentric for clamping the hook member.

In an embodiment of the invention, the eccentric for vertical adjustment extends through a horizontal oblong hole in the hook member. With such arrangement, bracing between the hook member and the front panel is not impeded by the eccentric for vertical adjustment. Also, the hook member may be supported both from above and from below on the eccentric for vertical adjustment.

BRIEF DESCRIPTION OF THE DRAWINGS

An embodiment of the invention is described in greater detail hereinafter with reference to the accompanying drawings, wherein.

DESCRIPTION OF A PREFERRED EMBODIMENT

Figure 1:
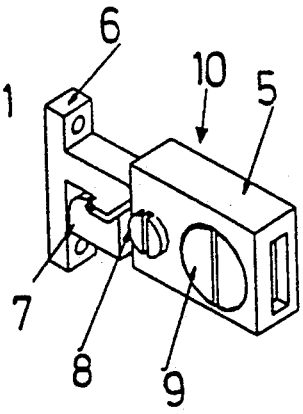
FIG. 1 is a perspective view of a front panel mounting device according to the invention.
Figure 2:
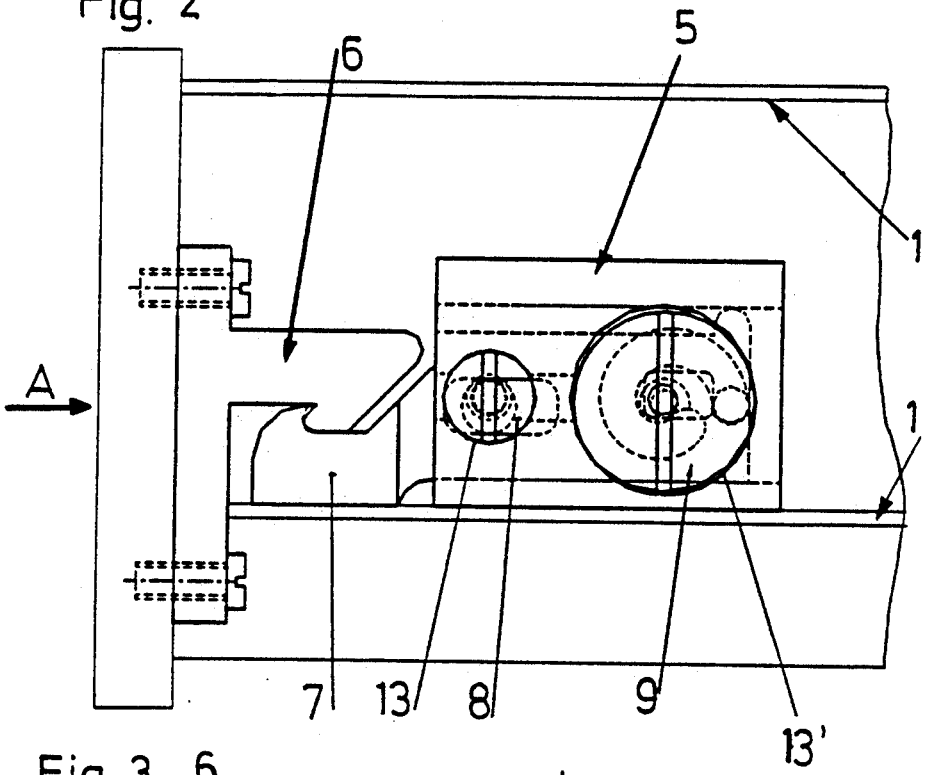
FIG. 2 is a side view of the front panel mounting device according to the invention, and in which parts of a drawer are shown.

In the drawings, a front panel is designated 4, a double-walled drawer frame is designated 1 and a drawer bottom is denoted by 3.

The basic parts of a front panel mounting device of the invention are a holding part 6 fastened to the front panel 4 and a carrying apparatus 10 fastened in the drawer frame 1.

The carrying apparatus 10 comprises a housing 5, a hook member 7 supported in housing 5 and eccentrics 8 and 9. The housing 5 forms an actual securing part which, in the illustrated embodiment, is inserted directly into the drawer frame 1. The hook member 7 is held by the eccentrics 8 and 9 in the housing 5.

Figure 7:
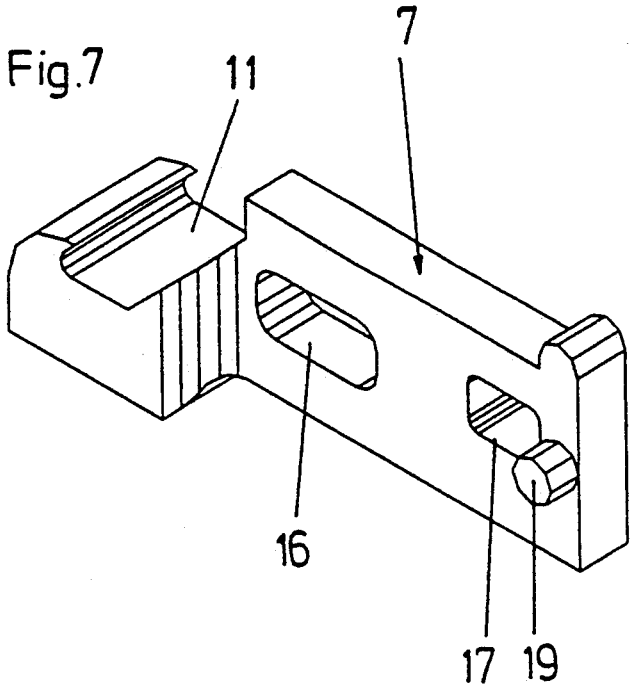
FIG. 7 is a perspective view of the hook member.
Figure 8:
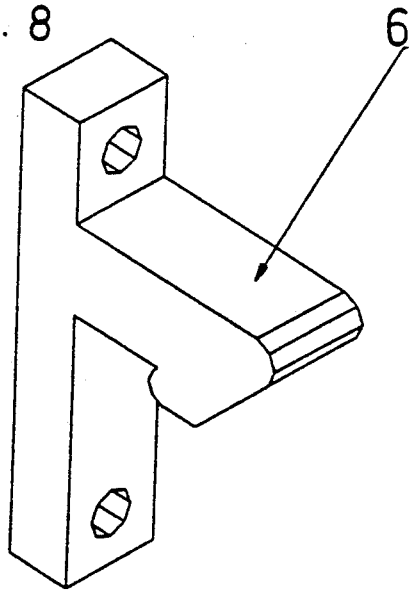
FIG. 8 is a perspective view of a holding part to be fastened on the front panel.
Figure 9:
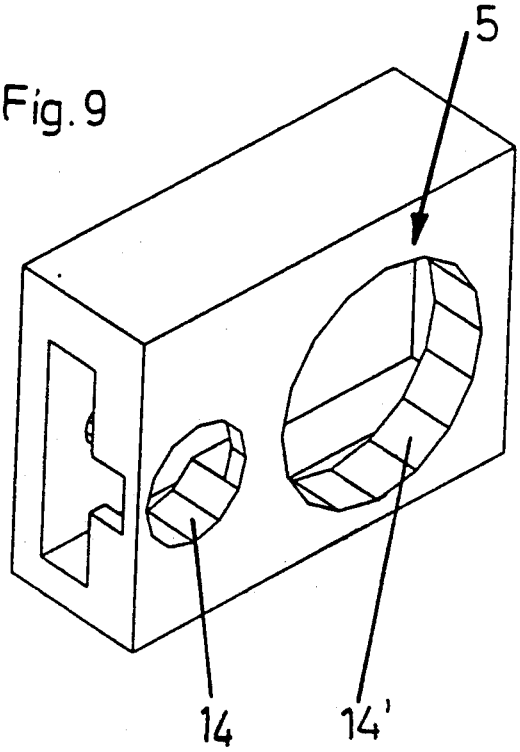
FIG. 9 is a perspective view of a housing in which is mounted the hook member.

The similarly hook-like holding part 6 is suspended on a hook of hook member 7. As may be seen from FIG. 7, the hook member 7 is provided with a broad rest or support surface 11 so that the front panel 4 with holding parts 6 at opposite ends thereof may be moved laterally in order to correct the lateral alignment of the front panel 4. The holding parts 6 are fastened by means of screws to the front panel 4.

The eccentric 9 achieves clamping between member 7 and part 6 and is provided at an end of the hook member 7 opposite the hook thereof. Eccentric 9 is supported in the housing 5 and has an axial length no longer than the width of housing 5, thereby to enable eccentric 9 and housing together to be inserted into the drawer frame 1.

Figure 3:
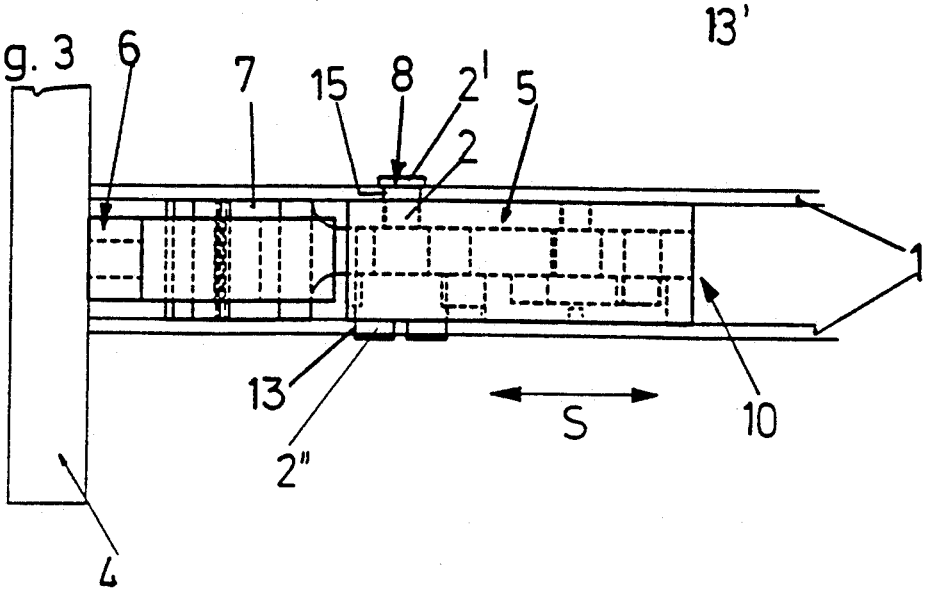
FIG. 3 is a plan view of the front panel mounting device according to the invention, and in which parts of the drawer similarly are shown.
Figure 4:
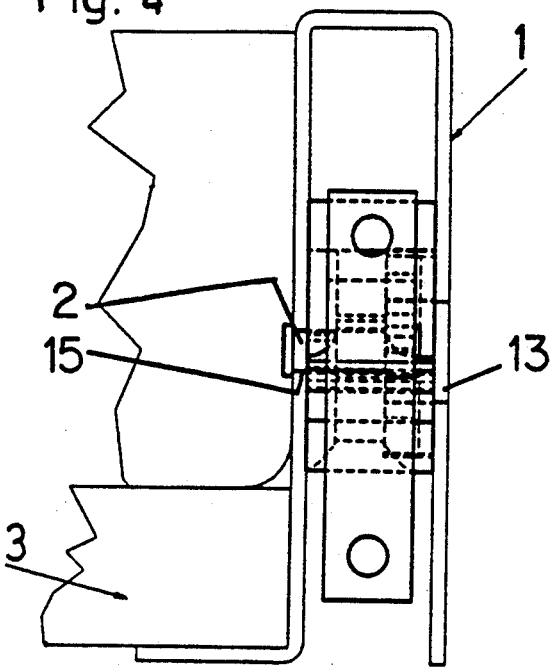
FIG. 4 is a view from the direction of an arrow A in FIG. 2.
Figure 5:
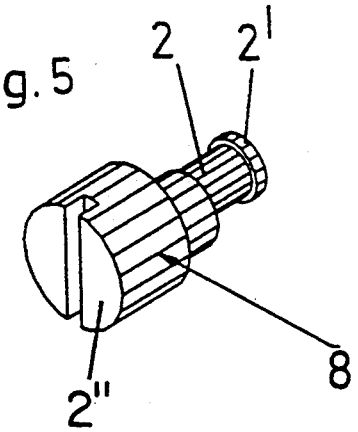
FIG. 5 is a perspective view of an eccentric for vertical adjustment.
Figure 6:
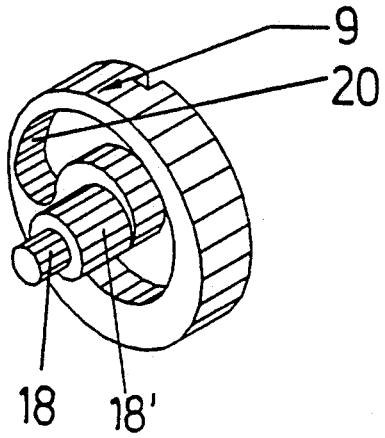
FIG. 6 is a perspective view of an eccentric for clamping a hook member.

If the eccentric 9 is rotated, the hook member 7 is moved in the direction of the arrow S of FIG. 3. If the hook 7 is moved to the right as shown in FIG. 3, the part 6 is pulled by member 7 and thus front panel 4 is pressed against the front end of drawer frame 1. This results in a clamping action which guarantees that the front panel 4 is braced absolutely securely against the drawer frames 1.

Further eccentric 8 is supported in hook member 7 between the eccentric 9 and the front hook end of member 7. Rotation of the eccentric 8 causes the hook member 7 to be swivelled about its pivot at the eccentric 9. A height adjustment of the front panel therefore is effected.

One wall of the frame 1 is provided with openings 13 and 13' which allow an adjusting tool, e.g. a screwdriver, to be applied to the eccentrics 8, 9. The housing 5 is likewise provided with openings 14 and 14' into which fit eccentrics 8, 9.

The eccentric 8 is longer than the housing 5 is wide, so that both of opposite ends of eccentric extend into respective walls of the drawer frame 1. Formed on a rear end of the eccentric 8 is a journal 2, on which is formed a thickened portion 2'. by means of journal 2 the eccentric 8 may be pressed through one of the walls of the drawer frame 1, such wall having a corresponding location opening 15. A front, wide journal 2" or head of the eccentric 8 has a slot for a screwdriver. The eccentric therefore serves not only as a part for vertical adjustment of the hook member 7, but also as a securing means for the carrying apparatus, i.e. the housing 5. In order not to impede the adjustment and clamping movements of the hook member 7, the eccentric 8 extends through a substantially horizontal longitudinal slot 16 in the hook member 7.

The eccentric 9 also extends through a longitudinal slot 17 in the hook member 7 and does so with a part 18' of a bearing journal 18. An outer end of the journal 18 extends into a hole in a rear wall of housing 5. Formed on the hook member 7 is a driving pin 9 which is guided in a spiral track 20 of the eccentric 9.

The front panel mounting device according to the invention not only allows rapid fastening and alignment of the front panel 4, it also allows the front panel 4 to be removed at any time from the drawer frames 1.

To assemble the carrying apparatus 10, the eccentric 8 is removed from the housing 5. The housing 5 is inserted, along with the hook member 7 held therein by means of the eccentric 9, into the drawer frame 1. Then the eccentric 8 is pressed through one side wall of the drawer frame 1 into the housing 5 until journal 2 with the thickened portion 2' snaps through opening 15 in the opposing wall of the drawer frame 1.

I claim:

1. In an assembly including a double-walled drawer frame having a pair of spaced walls and a front panel mounting device for mounting a respective side of a drawer front panel to said drawer frame, the improvement wherein said mounting device comprises:

a holding part to be fastened to the respective side of the front panel;

a housing positioned within said drawer frame between said spaced walls thereof, said housing having a pair of spaced walls;

a hook member positioned in said housing and including means for supporting said holding part; and an eccentric mounted in said pair of walls of said housing and supporting said hook member for adjustable movement relative to said housing, said eccentric having at opposite ends thereof respective journals fitted within respective holes formed in respective said spaced walls of said drawer frame and thereby mounting said housing at a fixed position within said drawer frame.

2. The improvement claimed in claim 1, wherein said hook member has a longitudinal dimension extending in a direction to be perpendicular to the front panel.

3. The improvement claimed in claim 2, further comprising another eccentric having opposite ends journaled in said spaced walls of said housing and supporting said hook member for selective movement in said direction relative to said housing and thereby for creating clamping in said direction between said hook member and said holding part.

4. The improvement claimed in claim 3, wherein said another eccentric has a portion extending through a slot in said hook member that is elongated in said direction.

5. The improvement claimed in claim 1, wherein said supporting means comprises a surface of said hook member that is widened in a direction to be parallel to the front panel.

6. The improvement claimed in claim 1, wherein said holding part has a hook-shaped end directed toward said hook member, and said hook member has at an end thereof directed toward said holding part a hook engaging said hook-shaped end of said holding part.

7. The improvement claimed in claim 1, wherein said eccentric includes a portion engaging said hook member such that rotation of said eccentric causes vertical movement of said hook member relative to said housing.

8. The improvement claimed in claim 7, wherein said portion of said eccentric extends through a slot in said hook member that is elongated in a direction to be perpendicular to the front panel.

9. The improvement claimed in claim 1, wherein a first said end of said eccentric has a thickened end capable of being snapped through the respective said hole in the respective said wall of said drawer frame.

* * * * *